United States Patent [19]

Behring

[11] Patent Number: 4,679,655

[45] Date of Patent: Jul. 14, 1987

[54] CONVERTIBLE STAND

[76] Inventor: Daniel F. Behring, 2519 Tenth St., Monroe, Wis. 53566

[21] Appl. No.: 918,146

[22] Filed: Oct. 14, 1986

[51] Int. Cl.[4] ..... A47C 9/10; A01M 31/02

[52] U.S. Cl. ..... 182/33; 182/154; 182/187; 182/223; 108/118

[58] Field of Search ..... 182/223, 222, 154, 20, 182/26, 33, 187; 108/118, 119, 120

[56] References Cited

U.S. PATENT DOCUMENTS

| | | | |
|---|---|---|---|
| 1,152,987 | 9/1915 | Spalding | 108/118 |
| 2,557,594 | 6/1951 | Bryan | 108/118 |
| 3,762,502 | 10/1973 | Lawson | 182/223 |
| 3,985,204 | 10/1976 | Lattig | 182/223 |
| 4,139,080 | 2/1979 | Wells | 182/187 |

FOREIGN PATENT DOCUMENTS

| | | | |
|---|---|---|---|
| 625172 | 4/1927 | France | 108/118 |
| 956560 | 4/1964 | United Kingdom | 108/118 |

*Primary Examiner*—Reinaldo P. Machado
*Attorney, Agent, or Firm*—Keith Schoff

[57] ABSTRACT

A portable support stand, convertibly used either as a stool or tree stand platform, is configured with adjustably hinged frame members, at least one of which is furcated, for being interspaced, crossed and pivotally joined to provide a stool when fitted is a sling seat or to provide a tree platform when toggled between limbs in the crotch of a tree.

6 Claims, 4 Drawing Figures

CONVERTIBLE STAND

FIELD OF ART

Bird watchers, game photographers, archers and firearm hunters may pursue their activities by positioning themselves in a tree or on the ground while waiting for wildlife to appear. Aids which may be necessary or desirable for such activities include portable seating appliances or platforms or mounting in trees.

BACKGROUND OF THE INVENTION

Hinged platforms for being toggled between tree crotch limbs are described in U.S. Pat. Nos. 3,762,502 and 3,985,204.

SUMMARY OF THE INVENTION

A portable, waist belt carried field appliance which may be used either as a stool or tree mounted platform comprises rigid, interspaced, adjustably scissor hinged gratings which are engaged by selectively positioning hinge pin means among a plurality of keyways provided along the length of one of the grates. The resulting pivotally hinged grates may be angularly crossed with the upwardly disposed ends receiving a sling seat to provide a stool or may be disposed with downwardly extending ends positioned against tree crotch limbs for being impaled in the limbs when by toggle action the hinged grates are forced into planar alignment to provide a platform.

Accessory components are provided which have alternative or multiple functions to minimize weight and complexity. Included among such components is an elongated canvas carrying pouch carried across the small of a user's back on a waist belt which is fitted with hemmed-in metal plates in each end, perforated for receiving pegged end extremities of supporting leg means when the pouch is used as a sling seat for a stool or as lacing holes when used as a swing seat in conjunction with a tree stand platform. Preferably included in the pouch with the grates are a further belt and a looped rope for providing a safety harness when attached to the user's waist belt, and two lengths of cord for first hoisting gear from the ground to the tree platform and then for lacing through the ends of the pouch and being tied to tree limbs to provide a swing seat in a tree for a person standing on the platform. Extension means for the grates may also be carried, perferably within tubular structure of the grates, but otherwise within the pouch, and as well other paraphernalia may be included as desired.

DESCRIPTION OF THE INVENTION

Figure 1:
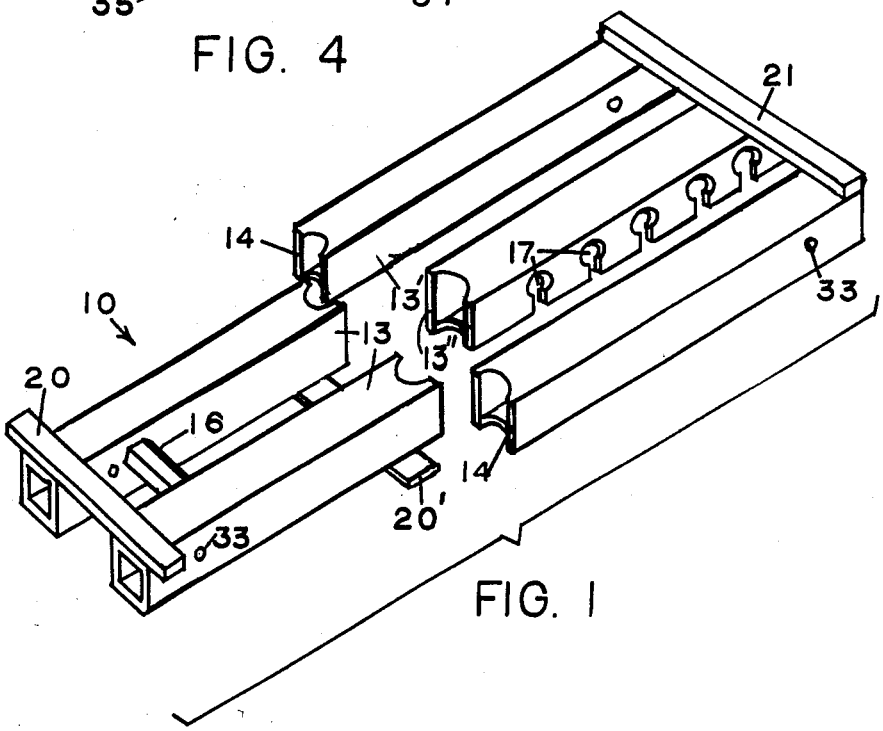
FIG. 1 is an exploded view in perspective of two grates which comprise one embodiment of invention as they would be deploye as a tree mounted platform.
Figure 2:
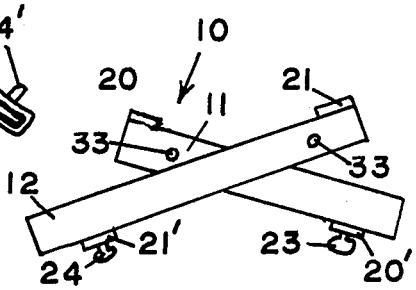
FIG. 2 is a side elevation of the article of FIG. 1 as it would be deployed between tree limbs prepatory to being toggled.

Referring to FIGS. 1 and 2, tree stand platform 10 is depicted in FIG. 1 with grates 11 and 12 separated for clarity, however, the actual embodiment of invention is assembled in the manner shown in FIG. 2. Grates 11 and 12 respectively comprise two fingered members and three fingered members, as shown, although any other number of fingers could be provided. Finger members 13 of grate 11 and fingers members 13', 13'' of grate 12 preferably comprise square aluminum tubing, but could also be configured from channel, angle, round tubing, rod, bar, or other suitable sturtural shape, and could be made of other suitable material such as steel, wood, synthetic resin, either reinforced with dissimilar fiber material such as glass, or unreinforced, however, it is preferred for tooth configured ends 14 of the finger members to be hard faced to aid in operably impaling the ends in tree limbs between which the grate structure may be toggled, and for this purpose as well as for strength and simplicity of manufacture, metal construction is preferred.

Finger members 13 are interposed between finger members 13', 13'' with pivot pin 16 being fixed to the inboard faces, preferably by welding. Keyways 17 are cut into finger member 13'' and are of a size and configuration suitable to receive pin 16 therethrough when the flats provided on the top and bottom of pin 16 are oriented parallel to the keyway slots by positioning the two grates perpendicularly, with pivot pin being freely rotatable in the keyhole portion of the keyways. When so assembled, the two grates 11 and 12 form a toggle link as shown in FIG. 2 which is expanded outwardly to impale the outer ends in tree limbs, for example, if placed in a tree crotch when the assembly is stood upon by a user. A stable rigid platform is thus provided which is positivlely locked in place if ends 14 of the finger members are undercut and sharpened to provide teeth projections only at the upper surface of the platform, however, such configuration is not shown.

Assembled as shown in FIG. 2, grates 11 and 12 are not separable because of transversely extending straps 20, 20' and 21, 21', which are respectively fixed to the two grates, but are mutually adjustable for enabling pivot pin 16 to be engaged selectively in any of keyways 17. The straps may be fixed either permanently or releasably by provisions of threaded connectors, for example. Thumb screws 23, 24 are provided to function as set secres in grates 11, 12, for retaining in stowed disposition within the finger members extension tubes 31, 32 (FIG. 3) with pins 33 being provided through the finger members as stops which limit the depth to which the extension tubes can be recessed within the finger members. If desired, thumbscrews 23, 24 can be omitted or can be used in addition to secure straps 20', 21' to grates 11 and 12, respectively. Either square tubing, round tubing or rod can be used for extension tubes 31, 32.

Tree stand platform 10 as shown in FIG. 2 is deployed between limbs forming the crotch of a tree before being stood upon by a user and toggled to impale the grate ends 14 into the limbs until the two grates 11 and 12 are in planar alignment with straps 20, 20', 21, 21' contacting finger members of the complementary grate to provide a firm, stable, level platform upon which the user can stand. In addition to the limiting-stop function provided by the straps, the positive locking engagement of pivot pin 16 in keyways 17 insures against inadvertent separation of the grates if a strap should fail or be omitted from the structure.

Figure 4:
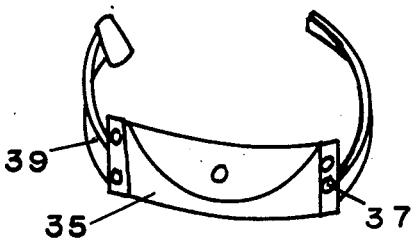
FIG. 4 is a perspective view of an embodiment of invention stowed for being transported.
Figure 3:
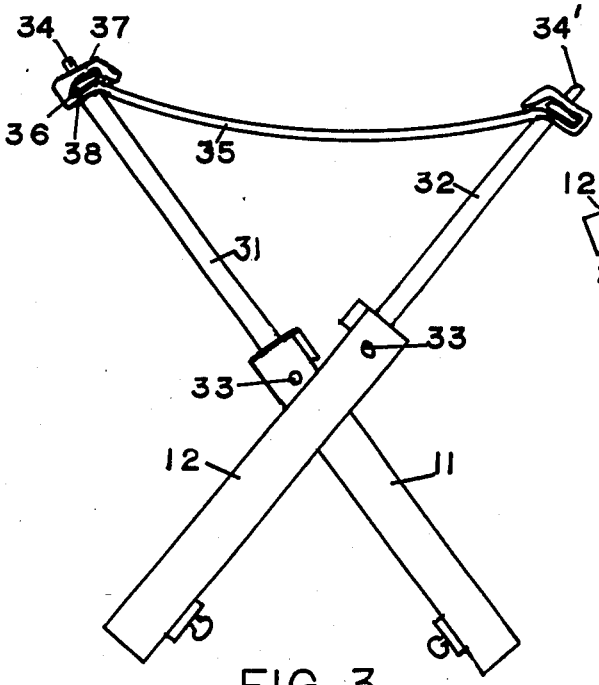
FIG. 3 is a side elevation of an embodiment of invention deployed as a stool.

In FIG. 3, grates 11 and 12 are shown deployed as crossed legs for a stool with extension tubes 31, 32 positioned in recesses formed by the inboard ends of finger members 13, 13', respectively. The concealed ends of the tubes seat on pins 33 and the upwardly projecting exposed ends of extension tubes 31, 32 are peg shaped and received through grommets 37 in sling seat 35 and aligned holes 38 in metal straps 36, 36' which are hemmed into the ends of seat 35. Seat 35, as shown in FIG. 4, alternatively provides a pouch through which waist belt 39 is threaded for transporting grates 11, 12 together with assorted cord, rope and belting and other paraphernalia as desired for transport, and in a further alternative use, is fitted with cord laced through grommets 37 which is then tied to tree limbs to provide a swing seat upon which a person standing on platform 10 can lean and rest. Extra rope and belting contained in the pouch is rigged together with waist belt 39 worn by the user to a tree limb as a safety harness, and the various materials may also be used to hoist gear from the ground to the tree platform. If appropriately threaded, or sharpened, extension tubes 31, 32 may be employed as tree steps. While five finger members 13, 13', 13'' are shown, any plural number of such finger members may be provided, and if desired, pivot means and keyways may be reversed in position in the grates, however, use of bolt and nut pivot means is not preferred for tree use.

I claim:

1. Portable, pivotally cross toggled grate means for use as tool or table legs or tree platform, comprising, (a) furcated grate means embodying a plurality of rigid elongated parallel finger portions having integrally incorporated therein first hinge structure component means disposed axially perpendicular to said finger portions, (b) means embodying a rigid elongated portion interspaced between at least two said finger portions having integrally incorporated therein second hinge structure component means complementary to that of said first hinge structure component means wherein said first component means and said second component means are selectively engaged to provide pivotal connection between said grate means and said member means at any of multiple linearly separated locations.

2. The apparatus of claim 1 wherein said first and second hinge structure component means collectively comprise axially extending fulcrum means and openings for receiving said fulcrum means.

3. The apparatus of claim 1 wherein said first and second hinge structure component means' axes are coincident and perpendicular to the resultant compressive force exerted on said apparatus when toggled and offset therefrom.

4. The apparatus of claim 1 wherein said grate means comprises a rigid portion transversely extending between said finger portions fixed thereto.

5. The apparatus of claim 1 comprising in addition a removable connecting member disposed to span from end extremities of said grate means to end extremities of said member means when said means are disposed angularly crossed and to be anchored on said end extremities thereby providing a surface for seating or table use.

6. The apparatus of claim 1 configured embodying extension portions operably received in said finger portions of said grate means and in said member means.

* * * * *